US011678410B2

(12) United States Patent
Nam

(10) Patent No.: US 11,678,410 B2
(45) Date of Patent: Jun. 13, 2023

(54) DETERMINING PRESENCE OF COMPATIBLE COOKWARE IN INDUCTION HEATING SYSTEMS

(71) Applicant: Haier US Appliance Solutions, Inc., Wilmington, DE (US)

(72) Inventor: Isaac Nam, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 381 days.

(21) Appl. No.: 16/520,772

(22) Filed: Jul. 24, 2019

(65) Prior Publication Data

US 2021/0029787 A1 Jan. 28, 2021

(51) Int. Cl.
*H05B 6/06* (2006.01)
*H05B 6/44* (2006.01)

(52) U.S. Cl.
CPC ..... *H05B 6/062* (2013.01); *H05B 6/44* (2013.01); *H05B 2213/05* (2013.01); *H05B 2213/07* (2013.01)

(58) Field of Classification Search
CPC ..... H05B 2213/05; H05B 2213/07; H05B 6/062; H05B 6/44
See application file for complete search history.

(56) References Cited

U.S. PATENT DOCUMENTS 5,648,008 A 7/1997 Barritt et al.
9,331,474 B1 * 5/2016 Mallik ..... H03K 17/0828
9,788,368 B2 * 10/2017 Fattorini ..... H05B 6/062
2009/0057299 A1 * 3/2009 Pastore ..... H05B 6/062 219/626
2012/0305546 A1 12/2012 Filippa
2014/0014647 A1 1/2014 Brosnan
2016/0037589 A1 2/2016 Altamura et al.
2018/0145675 A1 * 5/2018 Suh ..... H02H 7/222

FOREIGN PATENT DOCUMENTS

CN 107087321 A * 8/2017 ..... H05B 6/06
CN 108141921 A * 6/2018 ..... H05B 1/02
EP 1629698 B1 12/2006
WO WO-2017149126 A1 * 9/2017 ..... H05B 6/062

OTHER PUBLICATIONS

Lin, "Induction heating device and control method thereof," Oct. 2021 (Year: 2017).*
"Ding, Adjustment method of hard turn-on voltage of IGBT and induction cooker, 2017" (Year: 2017).*

* cited by examiner

*Primary Examiner* — Brian W Jennison
*Assistant Examiner* — Abigail H Rhue
(74) *Attorney, Agent, or Firm* — Dority & Manning, P.A.

(57) ABSTRACT

Induction cooktops and operational methods are provided herein. A method of determining presence of compatible cookware on an induction cooktop can include receiving a request to heat the induction cooktop, controlling at least one switching device to induce a current within an assumed piece of cookware with an induction coil of the induction cooktop, sensing a voltage associated with the at least one switching device, the voltage being proportional to current flowing in the induction coil, determining that the sensed voltage includes one or more voltage spikes above a first threshold, and determining that the assumed piece of cookware is absent when the sensed voltage includes the one or more voltage spikes.

12 Claims, 6 Drawing Sheets

DETERMINING PRESENCE OF COMPATIBLE COOKWARE IN INDUCTION HEATING SYSTEMS

FIELD OF THE INVENTION

The present subject matter relates generally to induction heating systems used, for instance, in induction cooktop appliances, and more particularly to determining the presence of compatible cookware in induction heating systems and appliances.

BACKGROUND OF THE INVENTION

Induction cook-tops heat conductive cookware by magnetic induction. An induction cook-top applies radio frequency current to a heating coil to generate a strong radio frequency magnetic field on the heating coil. When a conductive vessel, such as a pan, is placed over the heating coil, the magnetic field coupling from the heating coil generates eddy currents on the vessel. This causes the vessel to heat.

An induction cook-top will generally heat any vessel of suitable conductive material of any size that is placed on the induction cook-top. Since the magnetic field is not visible, unless some secondary indicator is provided, it is not readily apparent whether the induction cook-top is powered (on) or off. Thus, it is possible for items placed, on the induction cook-top to be heated unintentionally, which could damage such items and create other problems.

There are multiple methods of vessel or pan detection on an induction cook-top. Some of these include mechanical switching, current detection, phase detection, optical sensing, and harmonic distortion sensing. In pan sensing methods that utilize phase detection and amplitude measurements, a current transformer can be used. However, if an induction cooktop includes more than one induction coil incorrect identification of cookware may cause issues across multiple induction coils. For example, incompatible cookware placed on one induction coil may cause voltage spikes, hard switching, and, noise that is both audible, and detrimental to cooking performance.

Therefore, it may be desirable to be able to determine presence of compatible cookware in induction heating systems and appliances.

BRIEF DESCRIPTION OF THE INVENTION

Aspects and advantages of the invention will be set forth in part in the following description, or may be obvious from the description, or may be learned through practice of the invention.

In one example aspect of the present disclosure, a method of determining presence of compatible cookware on an induction cooktop is disclosed. The method can include receiving a request to heat the induction cooktop, controlling at least one switching device to induce a current within an assumed piece of cookware with an induction coil of the induction cooktop, sensing a voltage associated with the at least one switching device, the voltage being proportional to current flowing in the induction coil, determining that the sensed voltage includes one or more voltage spikes above a first threshold, and determining that the assumed piece of cookware is absent when the sensed voltage includes the one or more voltage spikes.

According to another example aspect of the present disclosure, an induction cooktop is disclosed. The induction cooktop may include an induction coil, a switching device configured to operate the induction coil, and a controller configured to operate the switching device. The controller can be configured to perform operations. The operations can include receiving a request to heat the induction cooktop, controlling at least one switching device to induce a current within an assumed piece of cookware with an induction coil of the induction cooktop, sensing a voltage associated with the at least one switching device, the voltage being proportional to current flowing in the induction coil, determining that the sensed voltage includes one or more voltage spikes above a first threshold, and determining that the assumed piece of cookware is absent when the sensed voltage includes the one or more voltage spikes.

According to yet another example aspect of the present disclosure, an induction cooktop is disclosed. The induction cooktop can include two or more induction coils, two or more switching devices configured to independently operate the two or more induction coils, and a controller configured to operate the two or more switching devices. The controller can be configured to perform operations. The operations can include receiving a request to heat the induction cooktop, controlling at least one switching device to induce a current within an assumed piece of cookware with an induction coil of the induction cooktop, sensing a voltage associated with the at least one switching device, the voltage being proportional to current flowing in the induction coil, determining that the sensed voltage includes one or more voltage spikes above a first threshold, and determining that the assumed piece of cookware is absent when the sensed voltage includes the one or more voltage spikes.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
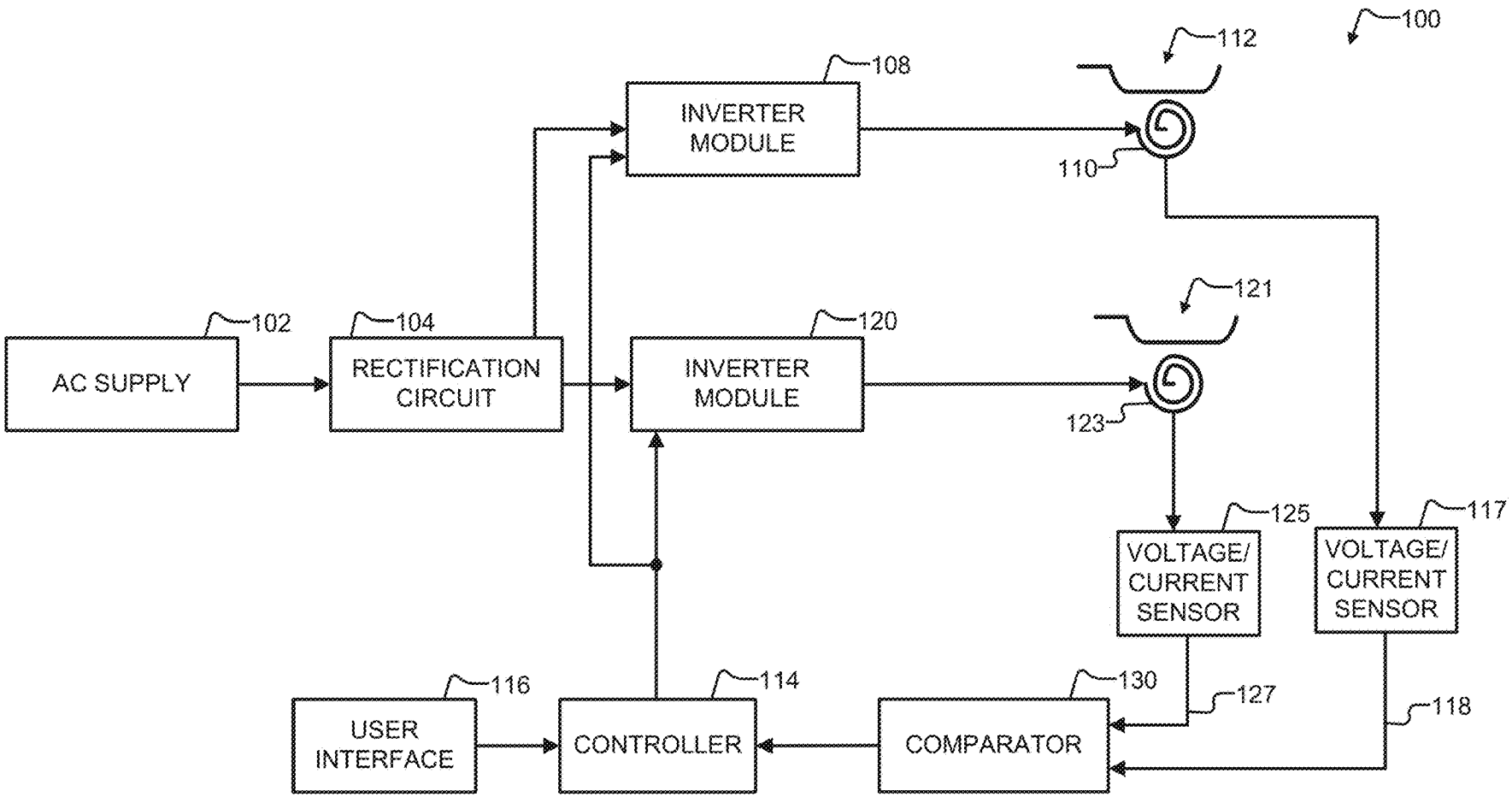
FIG. 1 shows a schematic block diagram of an induction heating system, according to example embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "or" is generally intended to be inclusive (i.e., "A or B" is intended to mean "A or B or both"). Furthermore, as used herein, terms of approximation, such as "approximately" or "substantially," refer to being within a ten percent margin of error.

As described herein, methods of determining the presence of compatible cookware placed on induction cooktops are provided. The methods may include determining if an optimum or sub-optimum switching conditions are occurring using a controller. Optimum and sub-optimum switching conditions occur when compatible cookware is placed on an induction coil. Alternatively, the methods may include determining if a hard switching condition is occurring using the controller. Hard switching conditions occur when incompatible cookware is placed on an induction coil. Subsequently, induction coils having compatible cookware may continue to heat the compatible cookware, while induction coils having incompatible cookware may be turned off, indicated to a user, or otherwise controlled to limit noise and damage to the induction cooktop. Accordingly, example embodiments of the present disclosure benefit consumers by providing more precise determination of compatible cookware, thereby ensuring longevity of an induction cooktop.

Example aspects of the present disclosure can have a number of technical effects and benefits. For instance, according to example aspects, compatible cookware can be determined by examining a voltage sensor for current spikes indicating incompatible cookware. This can provide for a more efficient determination of compatible cookware with reduced use of computing resources. In this regard, computing resources can be reserved for more core functions of the controller.

Turning to the drawings, FIG. 1 is a schematic block diagram of an induction heating system 100 of an induction cooktop, according to one embodiment of the present disclosure. In operation, the system 100 can be configured to detect a presence of a vessel or cookware 112 on an induction coil 110 and control the power supplied to the induction coil 110 at a power level selected by a user from a range of user selectable power settings, where the power supplied is based on size and type of cookware detected and a selected power setting.

As shown schematically in FIG. 1, the induction heating system 100 generally includes AC supply 102, which may provide conventional 60 Hz 120 or 240 volt AC supplied by utility companies, and a conventional rectifier circuit 104 for rectifying the power signal from AC supply 102. Rectifier circuit 104 may include filter and power factor correction circuitry to filter the rectified voltage signal. The induction heating system 100 may include two or more induction coils configured to be operated independently from one another, as described below.

The induction heating system 100 includes an inverter module 108 for supplying an alternating current to the first induction coil 110. Accordingly, the inverter module 108 may also be termed a variable frequency inverter module. The induction coil 110, when supplied by the inverter module 108 with an alternating current, inductively heats the cookware 112 or other object placed on, over, or near the induction coil 110. It will be understood that use of the term "cookware" herein is merely exemplary, and that term will generally include any object of a suitable type that is capable of being heated by an induction coil.

The frequency of the current supplied to the induction coil 110 by inverter module 108 and hence the output power of the induction coil 110 is controlled by controller 114 which controls the switching frequency of the inverter module 108 and one or more switching devices of the inverter module 108. The controller 114 may also be implemented as a microcontroller and/or gate driver to drive individual transistors or switching devices of the system 100 with pulse-width modulated signals.

The induction heating system 100 also includes an inverter module 120 for supplying an alternating current to second induction coil 123. Accordingly, the inverter module 120 may also be termed a variable frequency inverter module. The second induction coil 123, when supplied by the inverter module 120 with an alternating current, inductively heats the cookware 121 or other object placed on, over, or near the second induction coil 123. It will be understood that use of the term "cookware" herein is merely exemplary, and that term will generally include any object of a suitable type that is capable of being heated by an induction coil.

The frequency of the current supplied to the second induction coil 123 by inverter module 120 and hence the output power of the second induction coil 123 is controlled by controller 114 which controls the switching frequency of the inverter module 120 and one or more switching devices of the inverter module 120. The controller 114 may also be implemented as a microcontroller and/or gate driver to drive individual transistors or switching devices of the system 100 with pulse-width modulated signals.

Generally, if both pieces of cookware 112 and 121 are compatible pieces of cookware, the induction coils 110 and 123 may function normally. However, if either or both of cookware 112 and 121 are incompatible pieces of cookware, there may be significant noise levels apparent between the induction coil 110 and the induction coil 123. The noise may be audible under some circumstances, and may detract from a user experience in using an induction cooktop. However, according to example embodiments of the present disclosure, if either the cookware 112 or 121 is determined to be incompatible cookware, the associated induction coil 110, 123, respectively, may be disabled by the controller 114 to reduce or minimize noise.

A user interface 116 allows a user to establish the power output of the induction coils 110 and 123 by selecting a power setting from a plurality of user selectable settings. The user interface 116 is operatively connected to controller 114.

A voltage or current sensor 117 senses the current supplied to the induction coil 110 by the inverter circuit 108 and provides a current signal 118 to controller 114. The current sensor signal 118 is a signal that is representative of the current flowing through the induction coil 110 derived from one of a plurality of possible devices. For example, the current sensor 117 may include a current transformer, a current monitor, a Hall-Effect sensor, or any suitable current sensing device.

A voltage or current sensor 125 senses the current supplied to the second induction coil 123 by the inverter circuit 120 and provides a current signal 127 to controller 114. The current sensor signal 127 is a signal that is representative of the current flowing through the second induction coil 123 derived from one of a plurality of possible devices. For example, the current sensor 125 may include a current transformer, a current monitor, a Hall-Effect sensor, or any suitable current sensing device.

Controller 114 uses the inputs from the user interface 116 and the current sensor signal 118 from current sensor 117 to control energization of the induction coil 110. For example, the controller 114 can use the current sensor signal 118 to sense or detect the presence of the cookware 112 on the induction coil 110, determine that the cookware 112 is compatible cookware, and determine the appropriate switching frequency to achieve the output power corresponding to the user selected power setting. Controller 114 can also determine that cookware 112 is incompatible cookware, and de-energize the induction coil 110 to avoid noise and other drawbacks.

Controller 114 uses the inputs from the user interface 116 and the current sensor signal 127 from current sensor 125 to control energization of the second induction coil 123. For example, the controller 114 can use the current sensor signal 127 to sense or detect the presence of the cookware 121 on the second induction coil 123, determine that the cookware 121 is compatible cookware, and determine the appropriate switching frequency to achieve the output power corresponding to the user selected power setting. Controller 114 can also determine that cookware 121 is incompatible cookware, and de-energize the second induction coil 123 to avoid noise and other drawbacks.

According to one example, the controller 114 is operative to control the frequency of a power signal generated by inverter module 108 to operate the induction coil 110 at the power level corresponding to the setting selected by the user via user interface 116. The controller 114 monitors an output of hysteresis comparator 130. The hysteresis comparator 130 is configured to monitor the current sensor signal 118 and determine if it includes spikes above a first threshold. The first Threshold may be a hysteresis band of the hysteresis comparator 130.

The controller 114 processes the output of the hysteresis comparator 130 to determine the presence of the cookware 112 on the induction coil 110 as well as whether the cookware 112 is compatible cookware. Based on the determined compatibility, or lack of determination thereof, the controller 114 is configured to control power to the induction coil 110, which can include turning the power off if no compatible cookware is detected.

The current sensor signal 118 is sampled repetitively during each full switching cycle. The collection of sampled values of current sensor signal 118 over a switching cycle comprises a current signature, which is captured by the hysteresis comparator 130 and analyzed by the controller 114 to determine if there is a hard switching condition occurring (i.e., due to incompatible cookware 112) or if an optimal or sub-optimal switching condition is occurring (i.e., due to compatible cookware 112).

According to one example, the controller 114 is operative to control the frequency of a power signal generated by inverter module 120 to operate the second induction coil 123 at the power level corresponding to the setting selected by the user via user interface 116. The controller 114 monitors an output of hysteresis comparator 130. The hysteresis comparator 130 is configured to monitor the current sensor signal 127 and determine if it includes spikes above a first threshold. The first Threshold may be a hysteresis band of the hysteresis comparator 130.

The controller 114 processes the output of the hysteresis comparator 130 to determine the presence of the cookware 121 on the second induction coil 123 as well as whether the cookware 121 is compatible cookware. Based on the determined compatibility, or lack of determination thereof, the controller 114 is configured to control power to the second induction coil 123, which can include turning the power off if no compatible cookware is detected.

The current sensor signal 127 is sampled repetitively during each full switching cycle. The collection of sampled values of current sensor signal 127 over a switching cycle comprises a current signature, which is captured by the hysteresis comparator 130 and analyzed by the controller 114 to determine if there is a hard switching condition occurring (i.e., due to incompatible cookware 121) or if an optimal or sub-optimal switching condition is occurring (i.e., due to compatible cookware 121).

Figure 2:
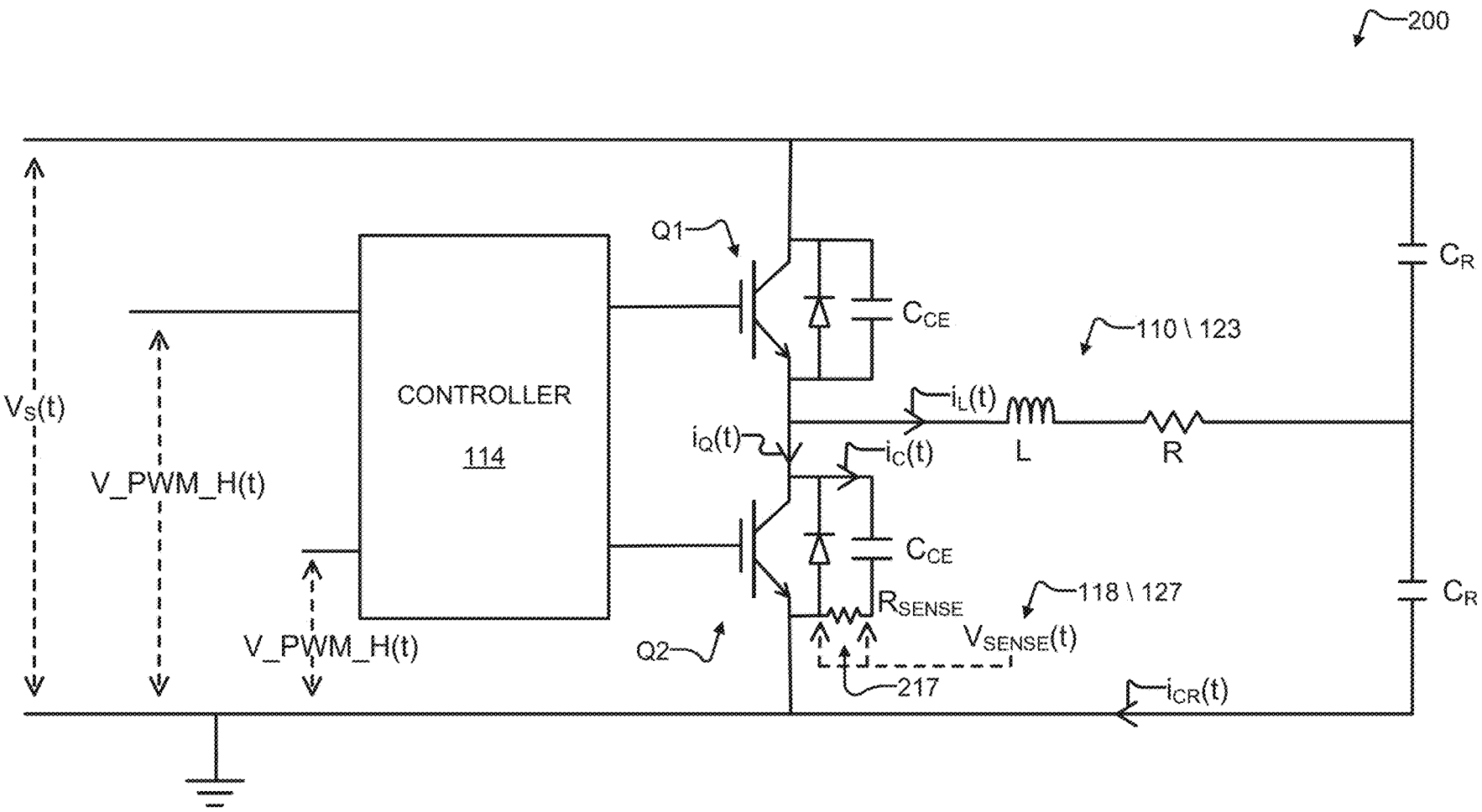
FIG. 2 is a schematic of an implementation of the inverter module and voltage sensor of the induction heating system of FIG. 1.

FIG. 2 is a schematic of an implementation of the inverter module 108 and current sensor of the induction heating system of FIG. 1. It is noted that only a portion related to induction coil 110 is illustrated. However, it should be understood that similar circuitry is appropriate for the second induction coil 123 and inverter module 120, as well.

As shown in FIG. 2 the induction heating system 200 includes a current monitor 217 arranged to sense current in at least one switching device Q2. The current monitor 217 includes a monitor resistor $R_{SENSE}$. The monitor resistor $R_{SENSE}$ may be coupled in series with a snubber capacitor $C_{CE}$ associated with the at least one switching device Q2. The voltage across the monitor resistor $R_{SENSE}$ is $V_{SENSE}(t)$. $V_{SENSE}(t)$ is proportional to current flowing through the snubber capacitor $C_{CE}$. It is noted that other current monitors may also be applicable. Furthermore, although not particularly illustrated, it is noted that $V_{SENSE}(t)$ may be amplified (e.g., with an operational amplifier) in order to give a scaled/centered input to the comparator 130.

As also shown, inverter module 108 (and also inverter module 120) is represented as a half-bridge series resonant converter circuit comprising switching devices Q1 and Q2, and capacitors $C_{CE}$ and $C_R$, which provide alternating current power signal to the induction coil 110 by the controlled switching of the direct voltage provided from the rectification circuit 104. The controller 114 controls the switching of Q1 and Q2 using one or more pulse-width modulated signals. In one embodiment, the switching devices Q1 and Q2 are Insulated-Gate Bipolar Transistors ("IGBT"). In alternate embodiments, any suitable switching devices can be used, including Metal-Oxide Semiconductor Field Effect Transistors and/or any other suitable devices.

Snubber capacitors $C_{CE}$ and resonant capacitors $C_R$ are connected between a positive power terminal and a negative power terminal to successively resonate with the induction coil 110. The induction coil 110 is connected between the switching devices Q1, Q2 and induces an eddy current in a vessel 112 located on or near the induction coil 110. The eddy current heats the vessel 112.

In one embodiment, this switching of switching devices Q1 and Q2 occurs at a switching frequency in a range between approximately 20 kilohertz to 50 kilohertz. When switching device Q1 is turned on, and switching device Q2 is turned off, the resonance capacitor $C_R$, the induction coil 110 and cookware 112 form a resonant circuit. When the switching device Q1 is turned off, and switching device Q2 is turned on, the resonant capacitor $C_R$, the induction coil 110, and the cookware 112 form a resonant circuit. Current monitor 217 provides a sensor signal 118 to hysteresis comparator 130, which outputs to controller 114.

Accordingly, the induction coil 110 of the induction cooktop can be arranged as a resonant tank circuit with a monitor resistor $R_{SENSE}$. Thus sensing a voltage associated with switching device Q2 can include sensing a first voltage at a first switching device Q2 of the at least two switching devices Q1 and Q2 via a voltage sensing device $R_{SENSE}$. It is noted that the sensed voltage is proportional to a current flowing in the switching device Q2. Therefore, the sensed voltage may be converted to current sensor signal 118.

By examining the current sensor signal 118, the induction heating system 200 can identify the compatibility of cookware 112 over the induction coil 110. In a similar manner, although not particularly illustrated in FIG. 2, by examining the current sensor signal 127, the induction heating system 200 can identify the compatibility of cookware 121 over the second induction coil 123.

As described briefly above, the system 100 may use voltage or current sensing circuitry to facilitate cookware detection, current detection, and compatibility determination. Induction coils associated with incompatible cookware may be turned off or de-energized to limit, reduce, or minimize noise in the system 100. Therefore, if compatible cookware 112 is present on the first induction coil 110, operation of the second induction coil 123 does not interfere with operation of the first induction coil 110. Similarly, if compatible cookware 121 is present on the second induction coil 123, operation of the first induction coil 110 does not interfere with operation of the second induction coil 123. Hereinafter, operational characteristics of the system 100 are described in detail.

Figure 3:
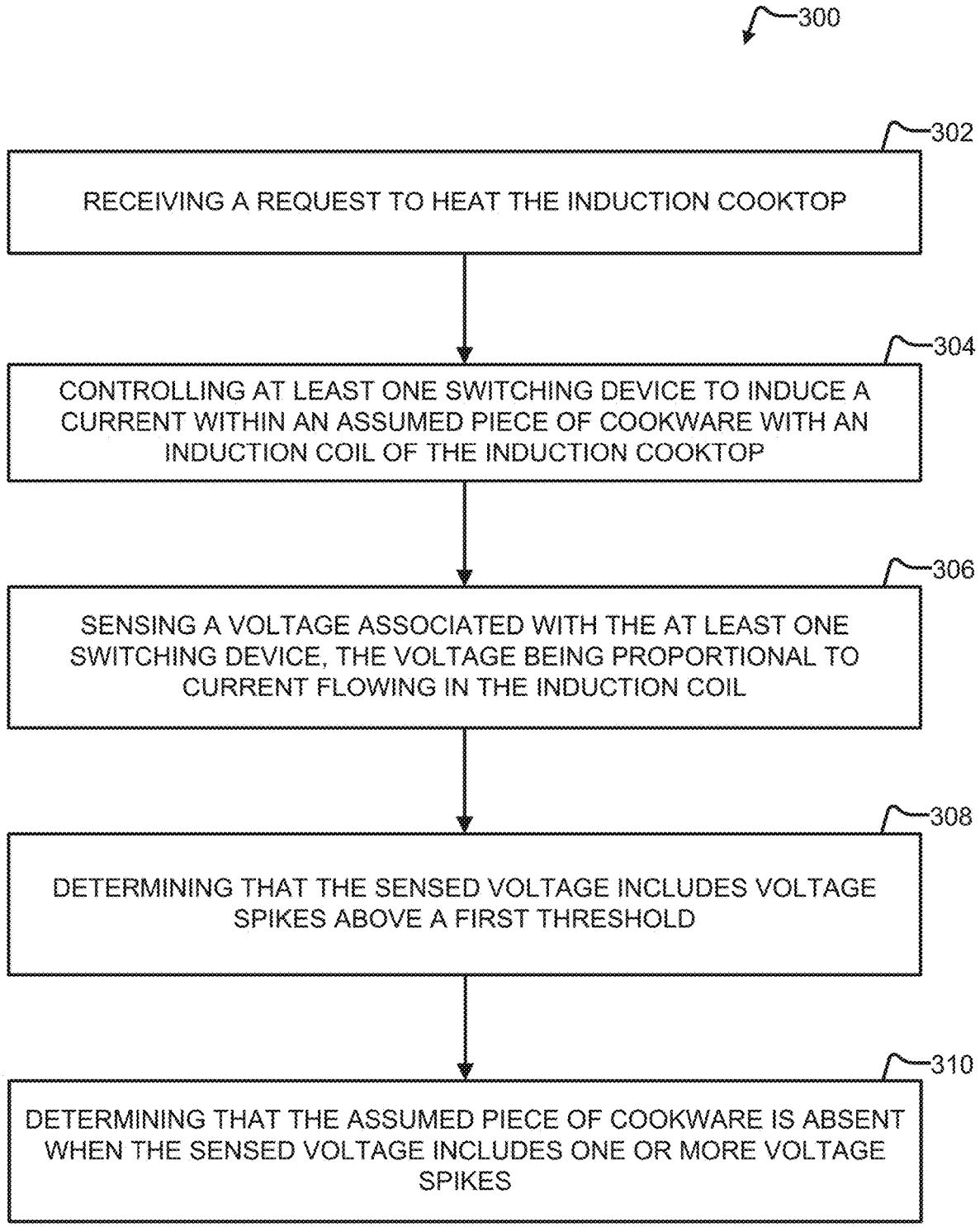
FIG. 3 is a flowchart of a method of determining presence of compatible cookware on an induction cooktop, according to example embodiments of the present disclosure.

FIG. 3 is a flowchart of a method 300 of determining presence of compatible cookware on an induction cooktop, according to example embodiments of the present disclosure. The method 300 may include receiving a request to heat the induction cooktop, at block 302. For example, a user may request to heat the induction cooktop using the user interface 116.

The method 300 can also include controlling at least one switching device to induce a current within an assumed piece of cookware with an induction coil of the induction cooktop, at block 304. For example, the controller 114 may direct an inverter module 108/120 to switch on/off switching devices Q1 and Q2 to flow current through the induction coil 110 or 120, respectively.

The method 300 can also include sensing a voltage associated with the at least one switching device, at block 306. The voltage is generally proportional to current flowing in the induction coil (e.g., 110 or 123). Furthermore, as described above, the induction coil of the induction cooktop is arranged as a resonant tank circuit with at least two switching devices, Q1 and Q2. Thus, sensing the voltage associated with the at least one switching device can include sensing a first voltage at a first switching device Q2 of the at least two switching devices Q1 and Q2 via a voltage or current sensing device 217 (e.g., $R_{SENSE}$).

The voltage or current sensing device 217 can include a voltage sensing resistor $R_{SENSE}$ operatively coupled to a capacitance $C_{CE}$ associated with the first switching device Q2. According to an example embodiment, the voltage or current sensing resistor $R_{SENSE}$ is coupled in series with the capacitance $C_{CE}$. According to some example embodiments, the second switching device Q1 of the at least two switching devices Q1 and Q2 does not include a voltage sensing resistor operatively coupled to a second capacitance $C_{CE}$ associated with the second switching device Q2. Although a second voltage or current sensing resistor can be used, it may be sufficient to only include a single voltage or current sensing resistor $R_{SENSE}$ per induction coil.

The method 300 can also include determining that the sensed voltage includes voltage spikes above a first threshold, at block 308. As described above, the first threshold may be a hysteresis band threshold of the hysteresis comparator 130.

The method 300 can also include determining that the assumed piece of cookware is absent and/or incompatible when the sensed voltage includes one or more voltage spikes, at block 310. For example, the presence of voltage spikes above the first threshold indicates that the hard switching condition is occurring. The hard switching condition generally occurs in the presence of incompatible cookware or no cookware at all.

Figure 4:
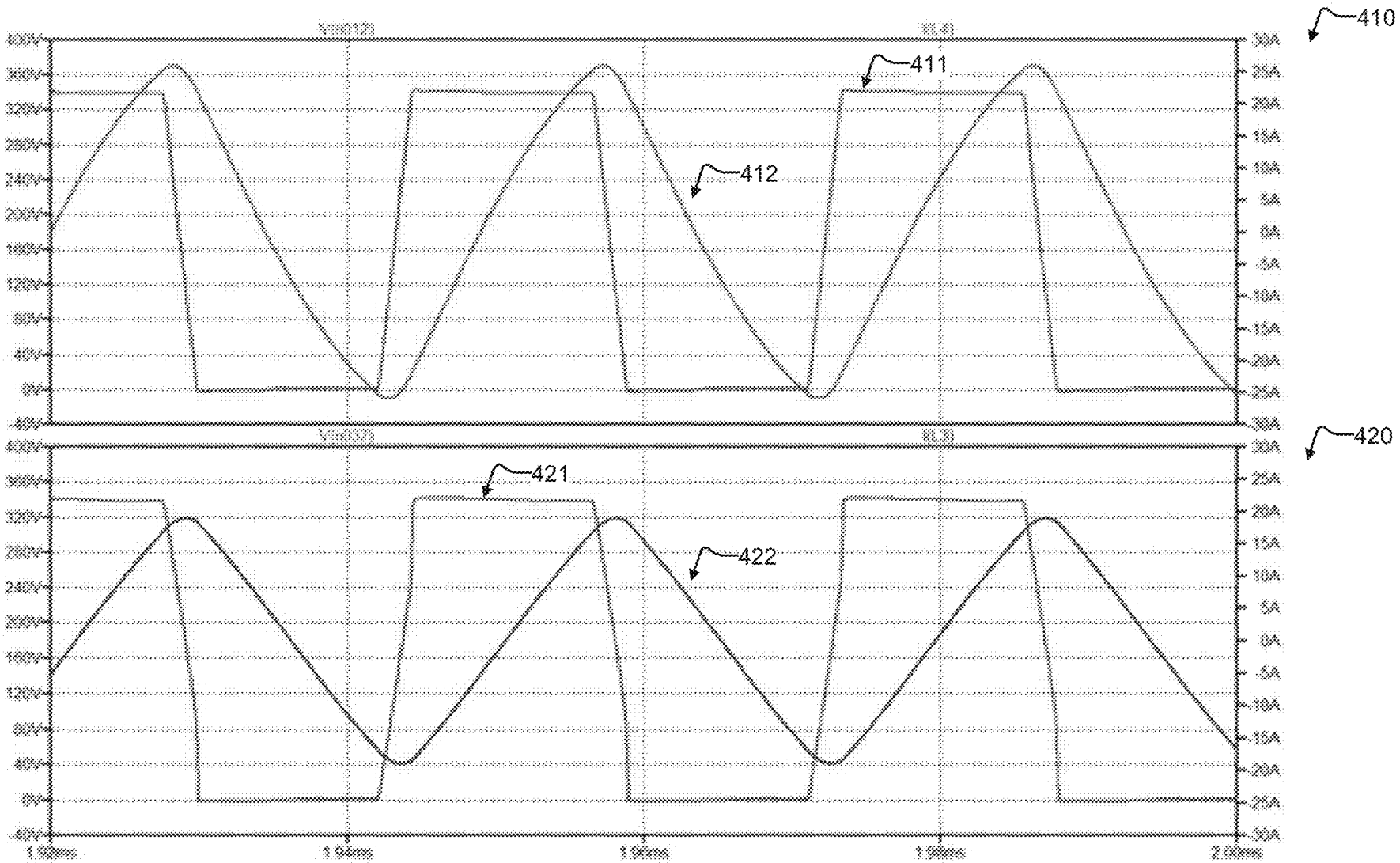
FIG. 4 is a plot of conventional cookware presence current sensing.

Hereinafter, several graphs and plots showing voltage spikes, absence of voltage spikes, and other scenarios, are described in detail. FIG. 4 is a plot of conventional cookware presence current sensing.

As shown in graph 410, the square waveform 411 is representative of the voltage across a snubber capacitor $C_{CE}$, and the saw tooth waveform 412 is representative of the current flowing in an induction coil during a soft switching (e.g., optimal or sub-optimal switching conditions). It is noted that graph 410 was measured in the presence of compatible cookware.

As shown in graph 420, the square waveform 421 is representative of the voltage across a snubber capacitor $C_{CE}$, and the saw tooth waveform 422 is representative of the current flowing in an induction coil during a hard switching condition. It is noted that graph 420 was measured in the presence of incompatible cookware.

Direct comparison of graphs 410 and 420 illustrate the difficulty in quickly determining if a hard switching or soft switching condition is occurring.

Figure 5A:
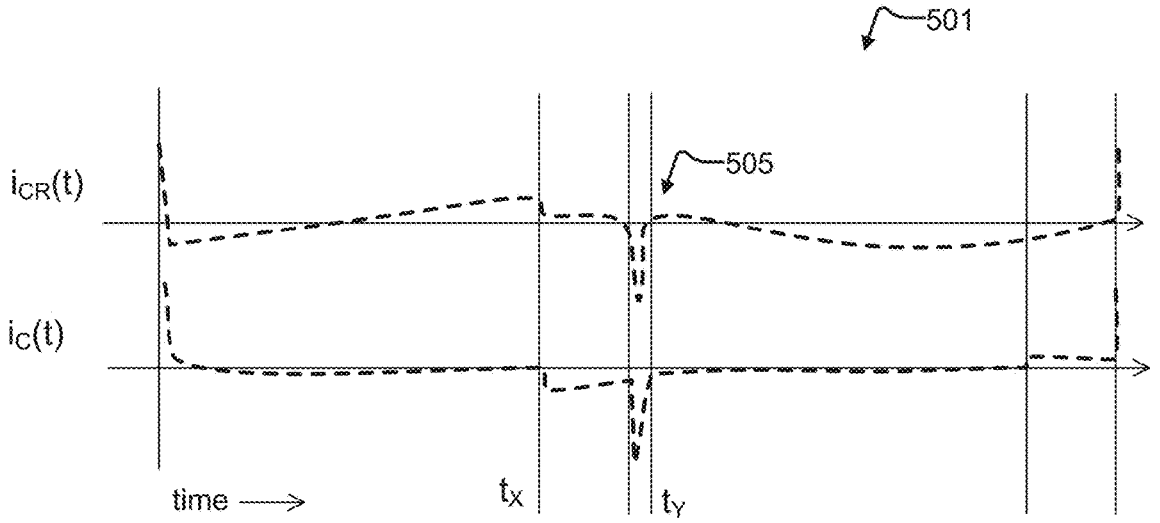
FIG. 5A is a plot of a hard switching condition, according to example embodiments of the present disclosure.
Figure 5B:
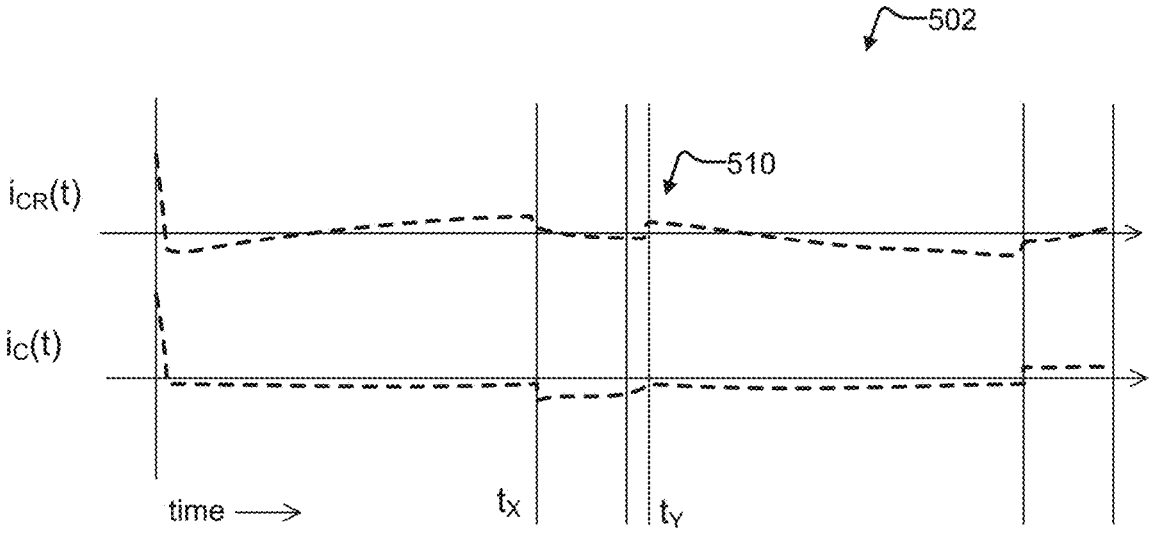
FIG. 5B is a plot of an optimal or sub-optimal switching condition, according to example embodiments of the present disclosure.

FIG. 5A is a plot of a hard switching condition, according to example embodiments of the present disclosure. FIG. 5B is a plot of an optimal or sub-optimal switching condition, according to example embodiments of the present disclosure.

As shown in FIG. 5A, voltage spikes 505 are apparent in the sensed current $i_C(t)$. In contrast, as shown in FIG. 5B, there are little to no voltage spikes in area 510, which corresponds to where hard switching may occur. Accordingly, graph 501 is representative of hard switching conditions when incompatible or no cookware is present on an induction coil. Graph 502 is representative of soft switching conditions (e.g., optimal or sub-optimal switching conditions) when compatible cookware is present on an induction coil.

Figure 6:
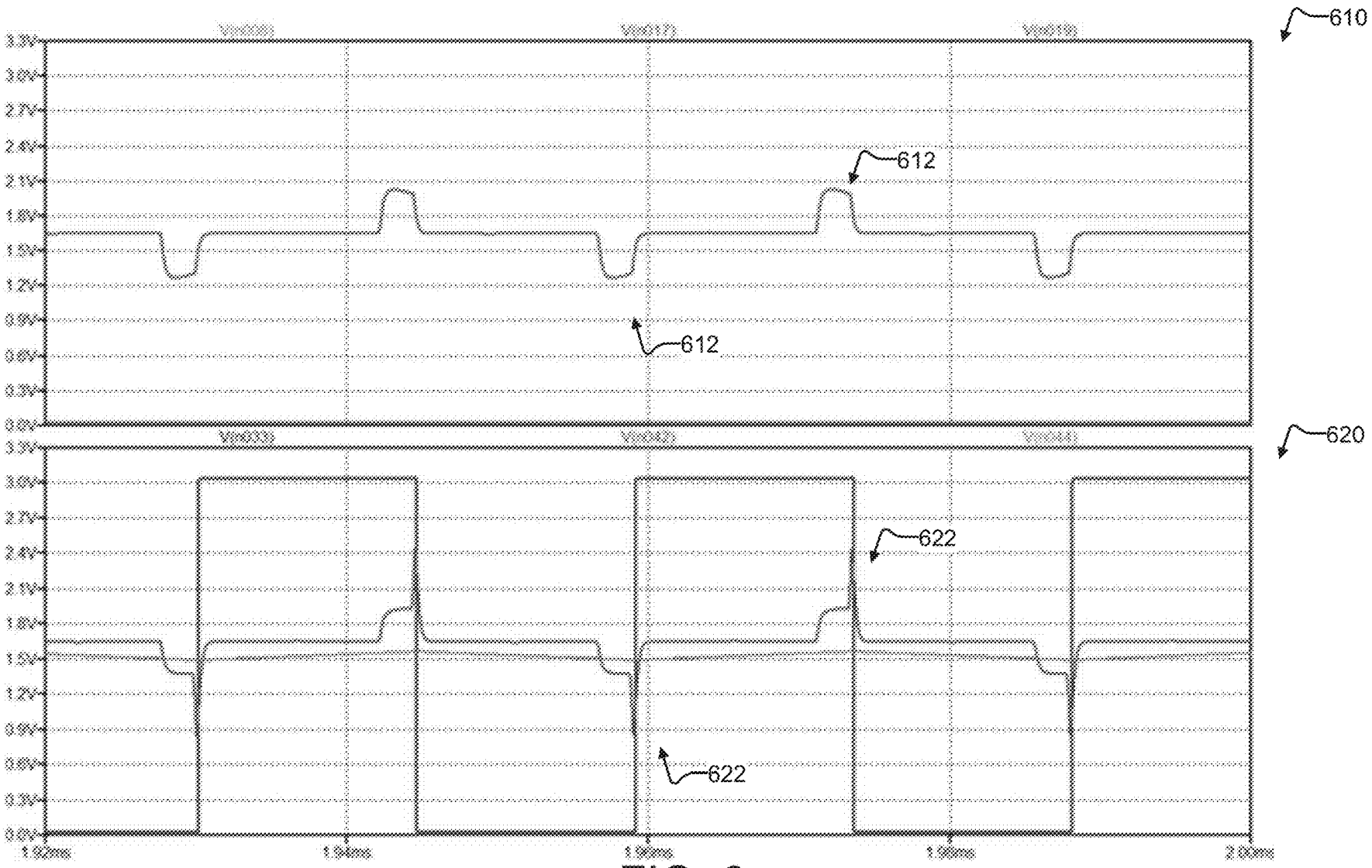
FIG. 6 is a plot of cookware presence voltage sensing, according to example embodiments of the present disclosure.

FIG. 6 is a plot of cookware presence voltage sensing, according to example embodiments of the present disclosure. As shown in graph 610, the input of hysteresis comparator 130 includes relatively smooth traces 612. This is indicative of compatible cookware present on an induction coil. In contrast, graph 620 shows the input of hysteresis comparator 130 including voltage spikes above a hysteresis band threshold at traces 622. This is indicative of incompatible cookware or no cookware present on an induction coil.

As can be seen from graphs 610 and 620, checking for high current spikes in $i_C(t)$ can be useful for detecting presence of a compatible cookware. The high current spikes in $i_C(t)$ occur due to hard switching in $V_{CE}(t)$. For example, since high $|d[V_{CE}(t)]/dt|$ occur in hard switching instances, $i_C(t)=C_{CE}*d[V_{CE}(t)]/dt$ exhibits current spikes 622.

As described above, methods of determining the presence of compatible cookware placed on induction cooktops have been presented in detail. The methods may include determining if an optimum or sub-optimum switching conditions are occurring using a controller. Optimum and sub-optimum switching conditions occur when compatible cookware is placed on an induction coil. Alternatively, the methods may include determining if a hard switching condition is occurring using the controller. Hard switching conditions occur when incompatible cookware is placed on an induction coil. Subsequently, induction coils having compatible cookware may continue to heat the compatible cookware, while induction coils having incompatible cookware may be turned off, indicated to a user, or otherwise controlled to limit noise and damage to the induction cooktop.

Accordingly, example embodiments of the present disclosure benefit consumers by providing more precise determination of compatible cookware, thereby ensuring longevity of an induction cooktop. Example embodiments can also provide for a more efficient determination of compatible cookware with reduced use of computing resources. In this regard, computing resources can be reserved for more core functions of the controller.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method of determining presence of compatible cookware on an induction cooktop, comprising:

receiving, by a controller, a request to heat the induction cooktop;

controlling, by the controller, at least one switching device to induce a current within a piece of cookware with an induction coil of the induction cooktop;

sensing, via a first voltage sensing device, a voltage associated with the at least one switching device, the voltage being proportional to current flowing in the induction coil, wherein sensing the voltage associated with the at least one switching device comprises sensing the voltage at a first switching device of the at least one switching device via the first voltage sensing device;

generating, by the first voltage sensing device, a current sensor signal based at least in part on the voltage, the current sensor signal being representative of the current flowing in the induction coil;

sampling, by a hysteresis comparator coupled to the controller and the first voltage sensing device, the current sensor signal repetitively during a switching cycle of the first switching device to capture a current signature of the current flowing in the induction coil;

determining, by the controller, that the voltage includes one or more voltage spikes above a first threshold based at least in part on the current signature output by the hysteresis comparator, the hysteresis comparator configured to monitor the current sensor signal to detect the presence of voltage spikes above the first threshold, wherein the voltage spikes above the first threshold are indicative of a hard switching condition associated with incompatible cookware;

determining, by the controller, that the piece of cookware is absent or incompatible when the voltage includes the one or more voltage spikes above the first threshold; and determining, by the controller, that the piece of cookware is present and compatible when the voltage lacks the one or more voltage spikes above the first threshold;

wherein the first voltage sensing device comprises a voltage sensing resistor operatively coupled to a capacitance associated with the first switching device.

2. The method of claim 1, wherein the induction coil of the induction cooktop is arranged as a resonant tank circuit.

3. The method of claim 1, wherein the voltage sensing resistor is coupled in series with the capacitance.

4. The method of claim 1, wherein the at least one switching device comprises the first switching device and a second switching device, and wherein the second switching device is operatively coupled to a second capacitance associated with the second switching device, the second capacitance comprising at least one of a capacitor or an inductor, and wherein the second switching device is not coupled to a second voltage sensing device.

5. The method of claim 1, wherein the first threshold is a hysteresis band threshold of the hysteresis comparator.

6. An induction cooktop, comprising:

an induction coil;

at least one switching device configured to operate the induction coil;

a voltage sensing device coupled to a first switching device of the at least one switching device, the voltage sensing device configured to sense a voltage associated with the first switching device, the voltage being proportional to current flowing in the induction coil, wherein the voltage sensing device senses the voltage at the first switching device, and wherein the voltage sensing device is configured to generate a current sensor signal based at least in part on the voltage, the current sensor signal being representative of the current flowing in the induction coil;

a hysteresis comparator coupled to the voltage sensing device, the hysteresis comparator configured to sample the current sensor signal repetitively during a switching cycle of the first switching device to capture a current signature of the current flowing in the induction coil; and a controller coupled to the hysteresis comparator, the controller configured to operate the at least one switching device and the first switching device, wherein the controller is configured to perform operations, the operations comprising:

receiving, by the controller, a request to heat the induction cooktop;

controlling, by the controller, at least the first switching device of the at least one switching device to induce a current within a piece of cookware with [[an]]the induction coil of the induction cooktop;

determining, by the controller, that the voltage includes one or more voltage spikes above a first threshold based at least in part on the current signature output by the hysteresis comparator, wherein the one or more voltage spikes above the first threshold are indicative of a hard switching condition associated with incompatible cookware;

determining, by the controller, that the piece of cookware is absent or incompatible when the voltage includes the one or more voltage spikes above the first threshold; and determining, by the controller, that the piece of cookware is present and compatible when the voltage lacks the one or more voltage spikes above the first threshold wherein the voltage sensing device comprises a voltage sensing resistor operatively coupled to a capacitance associated with the first switching device.

7. The induction cooktop of claim 6, wherein the induction coil of the induction cooktop is arranged as a resonant tank circuit.

8. The induction cooktop of claim 6, wherein the voltage sensing resistor is coupled in series with the capacitance.

9. The induction cooktop of claim 6, wherein the at least one switching device comprises the first switching device and a second switching device, and wherein the second switching device is operatively coupled to a second capacitance associated with the second switching device, the second capacitance comprising at least one of a capacitor or an inductor, and wherein the second switching device is not coupled to a second voltage sensing device.

10. The induction cooktop of claim 6, wherein the first threshold is a hysteresis band threshold of the hysteresis comparator.

11. The induction cooktop of claim 6, wherein the induction coil is a first induction coil, and wherein the induction cooktop further comprises:

a second induction coil;

a second switching device configured to operate the second induction coil, wherein the controller is configured to operate the second switching device, and wherein the controller is configured to perform operations comprising, determining that the piece of cookware is present and compatible when the voltage lacks the one or more voltage spikes above the first threshold;

wherein operation of the second induction coil does not interfere with operation of the first induction coil based on the determining that the piece of cookware is present and compatible on the first induction coil.

12. An induction cooktop, comprising:

two or more induction coils;

two or more switching devices configured to independently operate the two or more induction coils;

a voltage sensing device coupled to a first switching device of the two or more switching devices, the voltage sensing device configured to sense a voltage associated with the two or more switching devices, the voltage being proportional to current flowing in the induction coil, wherein the voltage sensing device senses the voltage at the first switching device, and wherein the voltage sensing device is configured to generate a current sensor signal based at least in part on the voltage, the current sensor signal being representative of the current flowing in the induction coil;

a hysteresis comparator coupled to the voltage sensing device, the hysteresis comparator configured to sample the current sensor signal repetitively during a switching cycle of the first switching device to capture a current signature of the current flowing in the induction coil; and a controller coupled to the hysteresis comparator, the controller configured to operate the two or more switching devices and the first switching device, wherein the controller is configured to perform operations, the operations comprising:

receiving a request to heat the induction cooktop;

controlling at least the first switching device of the two or more switching devices to induce a current within a piece of cookware with an induction coil of the induction cooktop;

determining that the voltage includes one or more voltage spikes above a first threshold based at least in part on the current signature output by the hysteresis comparator, wherein the one or more voltage spikes above the first threshold are indicative of a hard switching condition associated with incompatible cookware; and determining that the piece of cookware is absent when the voltage includes the one or more voltage spikes above the first threshold;

wherein the voltage sensing device comprises a voltage sensing resistor operatively coupled to a capacitance associated with the first switching device.

* * * * *